US006001181A

United States Patent [19]

Bullen

[11] Patent Number: 6,001,181

[45] **Date of Patent: *Dec. 14, 1999**

[54] AUTOMATED SEALANT APPLICATOR

[75] Inventor: George Nicholas Bullen, Oxnard, Calif.

[73] Assignee: Northrop Grumman Corporation, Los Angeles, Calif.

[ * ] Notice: This patent is subject to a terminal disclaimer.

[21] Appl. No.: 08/905,101

[22] Filed: Aug. 1, 1997

[51] Int. Cl.[6] ..... B05C 5/00

[52] U.S. Cl. ..... 118/679; 118/680; 118/323; 156/578; 901/16; 901/43

[58] Field of Search ..... 118/305, 307, 118/323, 207, 208, 211, 240, 256, 242, 669, 679, 680; 427/282, 207.1, 96, 8, 421, 256; 156/356, 357, 351, 367, 368, 378, 578; 901/1, 16, 43; 222/504; 239/91

[56] References Cited

U.S. PATENT DOCUMENTS

| | | | |
|---|---|---|---|
| 3,076,995 | 2/1963 | Rabeflow . | |
| 3,149,365 | 9/1964 | Adair, Jr. . | |
| 4,555,196 | 11/1985 | De Garmo . | |
| 4,566,816 | 1/1986 | Janssen . | |
| 4,723,860 | 2/1988 | Giblin et al. . | |
| 4,735,522 | 4/1988 | Myun-Sik . | |
| 5,215,130 | 6/1993 | Kojima et al. | 427/421 |
| 5,770,913 | 6/1998 | Mizzi | 901/1 |
| 5,794,825 | 8/1998 | Gordon et al. | 222/504 |
| 5,807,606 | 9/1998 | Mould et al. | 427/10 |
| 5,830,297 | 11/1998 | Nakahira et al. | 156/356 |
| 5,836,068 | 11/1998 | Bullen | 29/33 K |
| 5,848,458 | 12/1998 | Bullen | 29/33 |

FOREIGN PATENT DOCUMENTS

| | | |
|---|---|---|
| 3 234 963 A1 | 3/1984 | Germany . |
| 2 070 281 | 9/1981 | United Kingdom . |

*Primary Examiner*—Laura Edwards
*Attorney, Agent, or Firm*—Terry J. Anderson; Karl J. Hoch, Jr.

[57] ABSTRACT

The present invention is an automated sealant applicator held by a gantry tool and is computer directed and controlled for performing sealant operations on workpieces. The automated sealant applicator is computer directed and controlled for moving around a workpiece and for applying controlled amounts of sealants along precise paths, and with desired sealant patterns. The amount, path, and pattern of sealant are derived from engineering data. A CCD advanced vision system and/or a cutter chuck with a positioning and locating system can be used to precisely locate and apply sealant to the workpiece.

40 Claims, 4 Drawing Sheets

AUTOMATED SEALANT APPLICATOR

BACKGROUND OF THE INVENTION

1. Field of the Invention

The present invention relates to automated sealant applicators in general, and in particular to machine held, computer directed and controlled dispensers for performing sealant operations on workpieces.

2. Related Art

Sealant operations on workpieces are critical to ensure proper manufacture and stability of products to be assembled. One sealant operation typically includes the application of a sealing compound to a surface of a workpiece prior to final assembly or mating with another part. The sealant acts like a gasket and a corrosion barrier. Another type of sealing operation is filling or "taking up" mismatches between detail or mating parts.

Currently, the sealant is applied manually by an operator, for example with a manual pneumatically actuated applicator or handheld "sealant gun" comprised of a tube with liquid adhesive. The adhesive can be either pre-mixed or mixed as it is dispensed. The pneumatic actuation pushes the liquid adhesive from the tube. Yet other types of manual "guns" do not use pneumatic force, but instead use the physical force of a ram piston operated manually by a human.

During sealant operations, the operator first must resolve the predetermined location that the sealant is to be applied at. Then the operator has to manually dispense the sealant along a predetermined path, with a predetermined pattern, or in a crevice or mismatch with a predetermined amount of sealant with the manual sealant gun. The application of material is entirely operator dependent. Experienced operators are needed to estimate the amount of material to put on, but the amount is still not precisely measured. As such, since this process is subject to human manual interpretation, there is great room for error and inefficiency. This is because the operator can only "feel and guesstimate" the amount of sealant to dispense.

In addition, the pattern of sealant applied will never be a "true" pattern since it is subject to unsteady hands of human application. Also, typically, the operator errs to over dispense and not underdispense to ensure sufficient coverage of the adhesive. As a result, most workpieces have more sealant than is necessary. This creates enormous waste of the sealant, which is usually a very expensive resin. Thus, manual application of sealants to workpieces, such as for aircraft skins, is a time consuming, inaccurate, and wasteful process.

Therefore, what is needed is a device that eliminates the need for manual sealant operations. What is also needed is an automated device for dispensing a precise amount of sealant to reduce waste while still conforming to required engineering specifications. What is additionally needed is an automated device with an advanced vision system for accurately locating a workpiece and dispensing sealant at desired locations on that workpiece.

Whatever the merits of the above mentioned systems and methods, they do not achieve the benefits of the present invention.

SUMMARY OF THE INVENTION

To overcome the limitations in the prior art described above, and to overcome other limitations that will become apparent upon reading and understanding the present specification, the present invention is an automated sealant applicator held by a gantry tool and is computer directed and controlled for performing sealant operations on workpieces.

The automated sealant applicator is held to either a mobile, portable, or reconfigurable tool positioning system, or any other suitable gantry system, such as a numerically controlled robotic tool. The automated sealant applicator (used interchangeably with the term "dispenser") moves around a workpiece by computer direction and control. The dispenser is also computer directed and controlled to apply controlled amounts of sealants along precise paths, and with desired sealant patterns on the workpiece. The amount, path, and pattern of sealant are derived from engineering data and preprogrammed into the computer. A charge-coupled device (CCD) advanced vision system and/or a cutter chuck with a positioning and locating system can be used to precisely locate and apply sealant to the workpiece.

A feature of the present invention is the automation of sealant operations. Another feature of the present invention is the precise dispensing of sealant. Yet another feature of the present invention is the advanced vision system for accurately locating a workpiece and dispensing sealant at desired locations on that workpiece.

An advantage of the present invention is that it eliminates the need for manual sealant operations. Another advantage of the present invention is that it increases the speed with which a sealant operation can be performed. Another advantage of the present invention is the reduction of sealant waste. Yet another advantage of the present invention is the ability to perform repetitive sealant operations accurately.

The foregoing and still further features and advantages of the present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
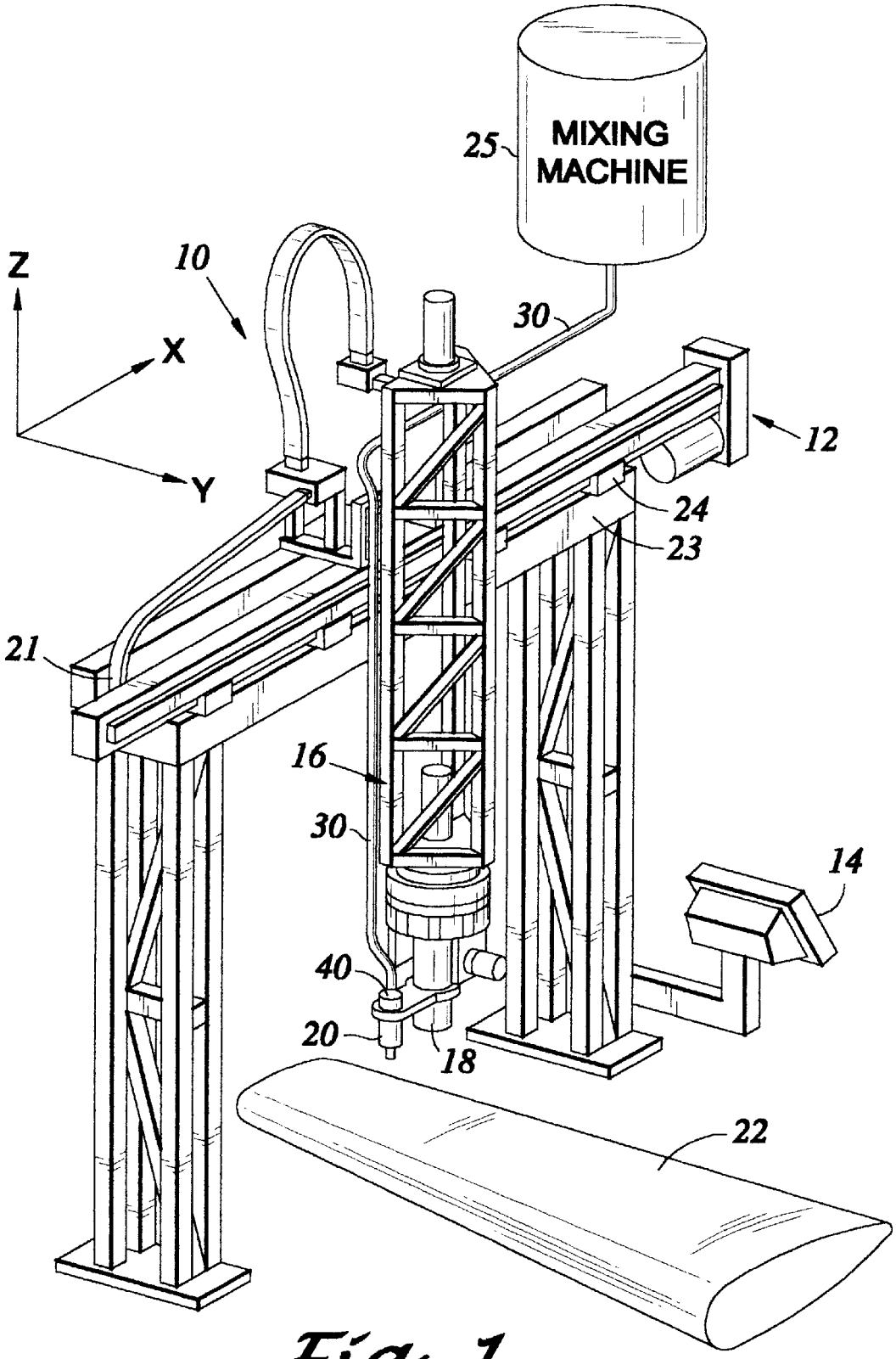
FIG. 1 is a perspective overview of the automated sealant applicator system of the present invention.

Overview:

FIG. 1 is a perspective overview of the automated sealant applicator system of the present invention. The automated sealant applicator system 10 includes a computer numerically controlled (CNC) gantry device 12 with a computer controller 14. The gantry device 12 is coupled to a movable robotic arm 16 having a numerically controlled robotic tool 18. A detachable sealant applicator 20 can be incorporated as the robotic tool 18 or can be held by the robotic tool 18, depending on the gantry device 12 utilized.

The automated sealant applicator 20 moves around complex geometry of a workpiece 22 by direction and control of the computer controller 14. The computer controller 14 is preprogrammed with engineering data of the particular workpiece and final structure. The applicator 20 is also computer directed and controlled for starting and stopping application of the sealant, applying controlled amounts of sealants along precise paths, and applying desired sealant patterns on the workpiece.

The engineering data includes the pertinent information for the workpiece or final structure such as the sealant required, quantity of sealant needed, type of sealant pattern, etc. As a result, predetermined precise amounts, paths, and patterns of the sealant are dispensed by the system 10 based on known engineering data for the particular workpiece and final structure.

It should be noted that many sealants are the product of two or more mixed resins. Two methods of applying sealant that needs to be mixed exist. The preferred method is a continuous feed method. A mixing machine 25 can mix the desired resins to form the desired sealant. When the mixing machine 25 is done mixing the resins, it can continuously feed the resulting sealant to the sealant applicator tool 20 via a feed tube 30. A conventional feed pump (not shown) can be used to continuously feed the sealant to the sealant applicator tool 20. The mixing machine 25 can be controlled by the computer 14 or independently, depending on the coordination required. As a result, many workpieces and sealant operations can be performed continuously without changing parts or turning machines off.

Another method is a non-continuous feed method. First, the resin is pre-mixed by hand or with mixing machines to form a sealant. The resulting sealant is then inserted in a dispensing cartridge 40. The dispensing cartridge 40 is coupled to the sealant applicator tool 20 for non-continuously dispensing the sealant. While the gantry device 12 is performing the sealant application routine, an operator can mix new sealant and fill new sealant cartridges. The cartridge 40 can have a sensor (not shown) coupled to the computer 14. The computer 14 can be preprogrammed with machine operator controls to detect a low sealant sensor signal from the cartridge 40 and pause the sealing application as the sealant runs low within the cartridge 40. Well known detection devices can be used to detect low sealant levels within the cartridge 40.

The gantry device 12 can be a mobile, portable, or reconfigurable tool positioning system, or any other suitable gantry system. In one mobile tool positioning system, such as the one disclosed and described in co-pending U.S. patent application Ser. No. 08/834,148 now U.S. Pat. No. 5,836,068 to Bullen, entitled MOBILE GANTRY TOOL, the teachings of which are incorporated herein by reference, a support assembly, a mobile unit with a multi-axis arm, and a multi-movement control device is included.

The sealant applicator is physically coupled to the multi-axis arm. The support assembly is located adjacent a workpiece and has a plurality of engagers. The mobile unit has proximity sensors 21 removably attached to the engagers. The mobile unit can therefore be detachably coupled to the support assembly. The proximity sensors 21 precisely locate and align the mobile unit with the support assembly before being coupled. Also, a self-leveling system can be incorporated in the system. This mobility allows the sealant applicator to be moved from workpiece to workpiece.

In one portable tool positioning system, disclosed and described in co-pending U.S. patent application Ser. No. 08/540,525 to Bullen, entitled NUMERICAL CONTROL MACHINE TOOL POSITIONING SYSTEM, the teachings of which are incorporated herein by reference, a support assembly, a portable unit with a multi-axis arm, and a multi-movement control device, is included.

The sealant applicator is physically coupled to the multi-axis arm. The support assembly is located adjacent a workpiece and removably engages with the portable unit. The portable unit can therefore be detachably coupled to the support assembly. Also, a self-leveling system can be incorporated in the system. This portability allows the sealant applicator to be transferred from workpiece to workpiece.

In one reconfigurable tool positioning system, disclosed and described in U.S. Pat. No. 5,848,458, in column 4, line 47 through column 12, line 15, to Bullen, entitled RECONFIGURABLE GANTRY TOOL, the teachings of which are incorporated herein by reference, a platform, a reconfigurable holding mechanism, a gantry frame, a multi-axis numerically controlled robotic arm, a multi-movement control device coupled to the mobile multi-axis tool, and a rotatable and translatable sine plate, is included.

The sealant applicator is physically coupled to the multi-axis arm. The sine plate 24 is rotatably and slidably coupled to the platform 23, and preferably rotates from a horizontal zero degree position to a vertical 90 degree position and translates along the platform. The gantry frame is slidably coupled to the platform 23. The robotic tool is movably coupled to the gantry frame and has a multi-axis range of motion. A workpiece is secured to the sine plate 24 by the reconfigurable holding mechanism. A plurality of workpieces can be clamped together and coupled to the reconfigurable holding mechanism. Also, a self-leveling system can be incorporated in the system.

Specific Embodiments:

Although many types of sealant applicators can be used with the automated sealant applicator system of the present invention, two specific types are disclosed below for the purposes of illustration and description. The below examples are not intended to be exhaustive or to limit the invention to the precise form disclosed. Many modifications and variations are possible in light of the above teachings.

Fay Sealing

Figure 2:
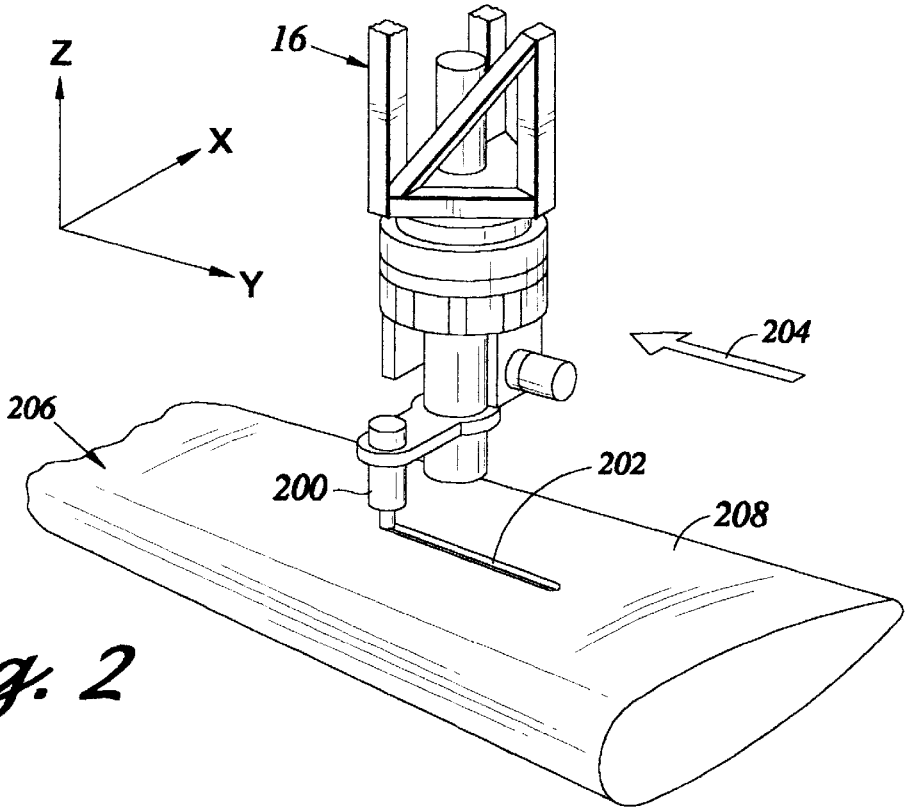
FIG. 2 illustrates a first specific embodiment of the automated sealant applicator system of the present invention.

FIG. 2 illustrates a first specific embodiment of the automated sealant applicator system of the present invention. Fay sealing is the application of a sealing compound directly to a surface of a workpiece prior to final assembly or mating with another part. As shown in FIG. 2, a sealant applicator tool 200 (coupled to the robot arm 16 of the gantry device 12 of FIG. 1) applies a sealant 202, for example, in the directed pattern indicated by arrow 204, on a surface 206 of a workpiece 208. The sealant 202 can be for many purposes, such as adhering mating parts, acting like a gasket and a corrosion barrier, etc.

The sealant tool 200 is directed and controlled by the computer 14 of the gantry device 12 (shown in FIG. 1). The computer 14 controls the path, pattern, amount, and location of the sealant 202 applied to the workpiece 208. As a result, the sealant can be placed along precise paths, and with desired sealant patterns on the workpiece 208. The amount, path, pattern, and location of sealant 202 are derived from engineering data and depend on the particular sealant operation to be performed on the particular workpiece (sealant pattern is discussed below in detail). The sealant 202 of FIG. 2 is depicted as a straight continuous bead of sealant for illustrative purposes only.

Figure 3:
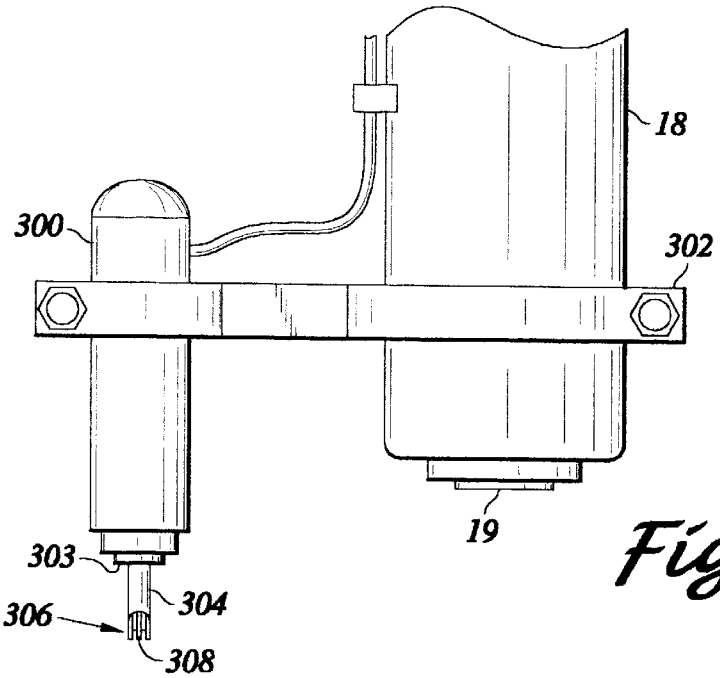
FIG. 3 is a detailed view of the first specific embodiment of the automated sealant applicator system of the present invention.

FIG. 3 is a detailed view of the first specific embodiment of the automated sealant applicator system of the present invention. The sealant applicator tool 200 of FIG. 2 can be a fay sealing applicator tool 300. The fay sealing applicator tool 300 can be detachably coupled to the robotic tool 18 (of the gantry device 12 of FIG. 1) by an attachment bracket 302. Also, any other device for detachably coupling the sealant tool 300 to the robotic tool 18 can be used. For flexibility, a conventional pneumatic SEMCO applicator can be used as the fay sealing applicator tool 300. In addition, the pneumatic SEMCO applicator can be modified to work with an electromechanical plunger device 303 (for pneumatically dispensing the sealant) automatically controlled by the computer 14 of the gantry device 12 of FIG. 1.

In addition, the fay sealing applicator tool 300 has a special dispensing tip 304 for providing a desired sealant pattern of sealant. An unlimited variety of tips, including conventional tips and custom tips, can be used with the system to apply different sealant patterns. The particular sealant pattern to be applied is derived from known engineering data and requirements of the particular workpiece and/or final structure.

The computer 14 of the gantry device 12 (shown in FIG. 1) can be preprogrammed with the known engineering data to work with different sealant applicator tips to apply any desired sealant bead pattern to the workpiece, depending on the type of sealant bead desired. For example, a continuous sealant bead with sawtooth grooves or a staggered grooved sealant bead can be applied to the workpiece. FIG. 3, as one example, depicts a tip 304 for producing the continuous sealant bead with sawtooth grooves. The tip 304 of FIG. 3 has a dispensing head 306 which is oriented at angle from the applied surface. The head 306 can have teeth 308 to provide the required sawtooth grooves.

Figure 4:
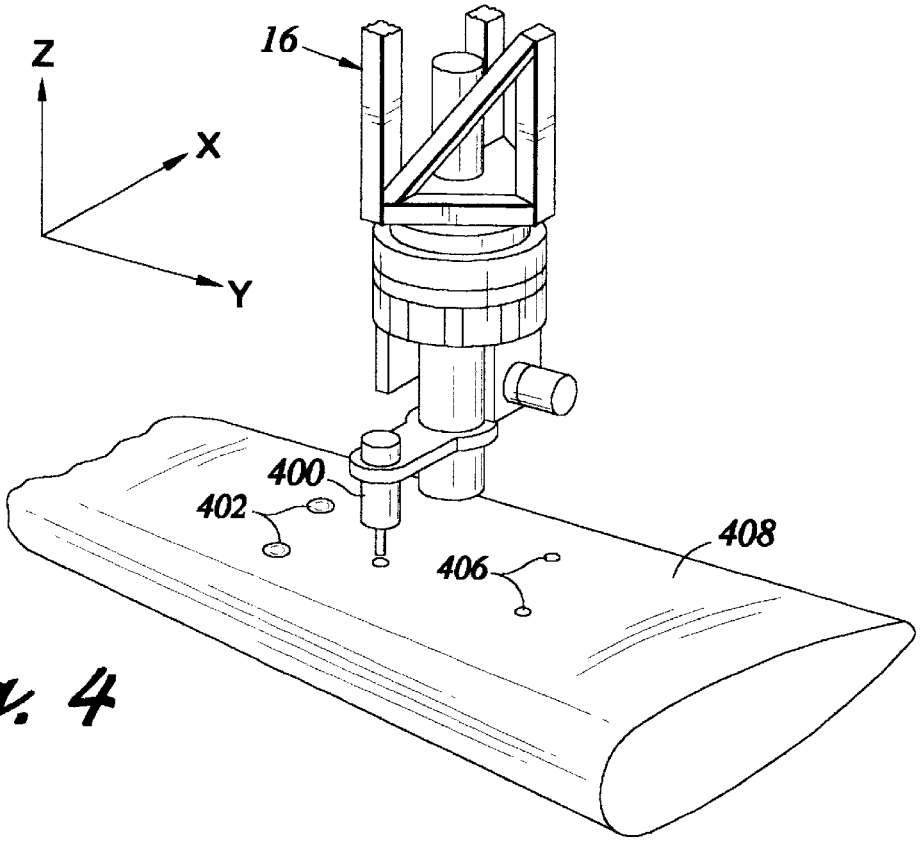
FIG. 4 illustrates a second specific embodiment of the automated sealant applicator system of the present invention.

Liquid Shimming:

FIG. 4 illustrates a second specific embodiment of the automated sealant applicator system of the present invention. Because of waviness inherent with some workpieces, such as a bagged side of many composite components, liquid shim sealing is required at these interfaces. For example, liquid shimming is used on the F/A-18 E/F aircrafts with a Dexter-Hysol sealant, a two-part, high viscosity, liquid adhesive. For liquid shimming, enough sealant is applied to produce overflow or "squeeze-out" after completely filling the gap. As such, there is great manual sensitivity of this operation.

As shown in FIG. 4, a sealant applicator tool 400 (coupled to the robot arm 16 of the gantry device 12 of FIG. 1) applies a sealant 402, in a crevice or hole 406 of a workpiece 408. In this particular case, the sealant 402 acts like a shim or filler and a corrosion barrier, among other things.

Similar to the sealant tool 202 of FIG. 2, the sealant applicator tool 400 is directed and controlled by the computer 14 of the gantry device 12 (shown in FIG. 1). The computer 14 controls the path, pattern, amount, and location of the sealant 402 applied to the workpiece 408. As a result, the sealant can be placed precisely in crevices and holes, and with desired sealant patterns on the workpiece 408. The amount, path, pattern, and location of sealant 402 are derived from engineering data and depend on the particular sealant operation to be performed on the particular workpiece. The sealant 402 of FIG. 4 is depicted as a overflowing bead of sealant for illustrative purposes only.

As a specific working example, during assembly of a composite part, after a composite skin is located on a substructure, pilot holes are drilled through the skin and substructure for temporary fasteners, by for example the gantry device 12, with a drill tool as the robotic tool 14 of FIG. 1. The temporary fasteners are utilized to maintain part location during assembly. In most cases, temporary fasteners also provide clamping pressure on the skin and substructure to squeeze out the excess liquid shim. On fuselage skins, all of the fastened holes are usually clamped while the liquid shim cures. The liquid shim is applied directly to, for example, an inner mold line of the skin.

Figure 5:
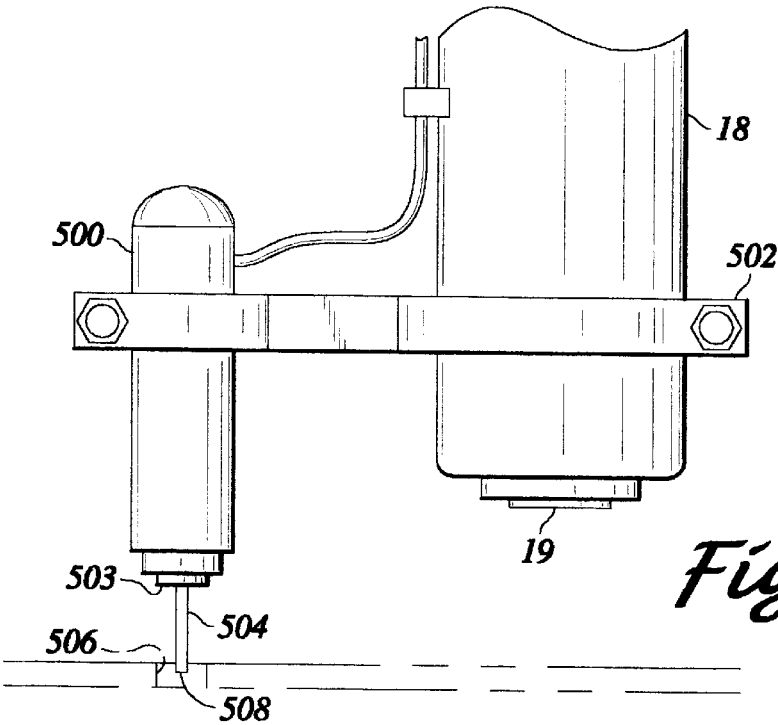
FIG. 5 is a detailed view of the second specific embodiment of the automated sealant applicator system of the present invention.

FIG. 5 is a detailed view of the second specific embodiment of the automated sealant applicator system of the present invention. The sealant applicator tool 400 of FIG. 4 can be a liquid shimming sealing applicator tool 500. The liquid shimming applicator tool 500 can be detachably coupled to the robotic tool 18 (of the gantry device 12 of FIG. 1) by an attachment bracket 502. Also, any other device for detachably coupling the sealant tool 500 to the robotic tool 18 can be used. For flexibility, a conventional pneumatic SEMCO applicator can be used as the liquid shimming applicator tool 500. In addition, the pneumatic SEMCO applicator can be modified to work with an electromechanical plunger device 503 automatically controlled by the computer 14 of the gantry device 12 of FIG. 1.

In addition, the liquid shimming applicator tool 500 has a special dispensing tip 504 for providing a desired amount of sealant in a desired pattern in a hole or crevice 506. An unlimited variety of tips, including conventional tips and custom tips, can be used with the system to apply different sealant patterns. The particular sealant pattern to be applied is derived from known engineering data and requirements.

Similar to the sealant tool 302 of FIG. 3, the computer 14 of the gantry device 12 (shown in FIG. 1) can be preprogrammed with the known engineering data to work with different sealant applicator tips to apply any desired sealant bead pattern to the workpiece, depending on the type of sealant bead desired. For example, a large overflow sealant bead can be applied to the workpiece. FIG. 5, as one example, depicts a tip 504 for producing a large overflow sealant bead. The tip 504 of FIG. 5 has a dispensing head 508 with an opening parallel to the applied surface. The head 508 can have slits or patterns (not shown) to provide a desired pattern.

Figure 6:
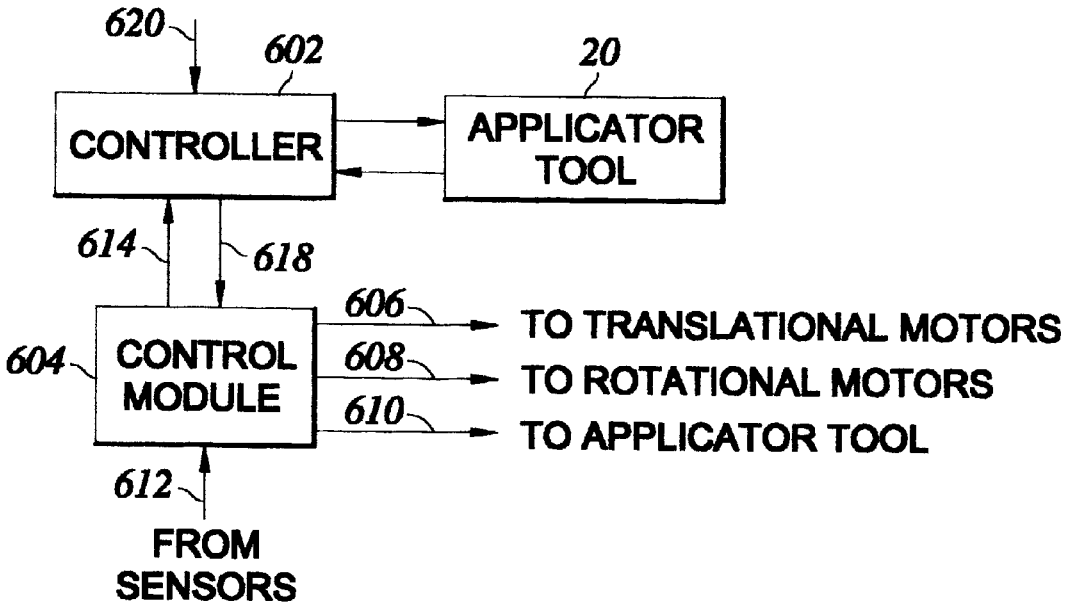
FIG. 6 is a block diagram of a computer controller for operation of the system of the present invention.

Operation:

FIG. 6 is a block diagram of a computer controller for operation of the system of the present invention. The automated sealant applicator tool 20 is controlled by a control system comprised of a tool computer numerical control (CNC) controller 602 and a CNC device 604, as illustrated in FIG. 6.

The tool computer numerical control (CNC) device 604 can be a conventional servo control module 604. The servo control module 604 sends translation signals 606 to translational motors of the gantry device 12 of FIG. 1, rotation signals 608 to rotational motors of the gantry device 12 of FIG. 1, and operation signals 610 to the sealant applicator tool 20 of FIG. 1. The translation and rotation signals effectuate movement of the gantry tool, as described in the above referenced co-pending patent applications. The operation signals 610 can be open/close valve signals for controlling a valve of the sealant applicator tool 20 which effectuates control and precise and accurate dispersement of the sealant.

Also, the module 604 receives sensor signals 612 from sensors, such as linear sensors and rotational sensors (discussed below). The sensor signals 612 measure the proximity of (a) the initial machining part of the sealant applicator tool 20 (e.g. a tip of the sealant applicator tool) to a desired set of X, Y and Z coordinates (referred to as the "vector"), and (b) the orientation of the tool path (e.g. the sealant pattern or location) to the contour of the workpiece surface (referred to as the "normal") as defined by rotation and pivot angles.

The module also receives task signals 614 from a conventional industrial controller 602, and sends task completion signals 618 to the controller 602. The controller 602 generates the task signals 614 from a workpiece database 620 that is sent to the controller 602. The workpiece database 620 comprises a set of task signals 614 and defines the work to be performed on workpiece, such as the type of sealant required, quantity of sealant needed, type of sealant pattern, location that the sealant is to be applied at etc.

As shown in FIG. 6 each task signal 614 defines a task to be performed on the workpiece and is generated by the controller 602. For example if the task is to seal a hole in the workpiece, a basic data item in the task signal 614 would be the location of the sealant applicator tip, i.e. the vector, and is defined by x, y and z coordinates in relation to a workpiece reference datum. Another data item is the normal, which is defined by angles about the rotation and pivot axes at a selected vector. Other data to be defined could include, for example, the dispensing amount, the feed rate at which the sealant is dispensed onto the workpiece, and the distance that the sealant applicator tip is to be from the workpiece.

The controller 602 holds in memory each task signal 614 in the workpiece database 620. This workpiece database 620 could be provided by a computer aided design ("CAD") program defining a finished workpiece and could be entered in the controller 602 by manual or magnetic means.

In addition, the controller 602 determines when a task signal 614 (e.g. comprising the vector, normal, sealant application rates, location, type of pattern etc.) is sent to the control module 604. For example, the controller 602 could be programmed to send the task signal 614 to the module 604 only after a sealant layer is applied to the workpiece pursuant to a previous task signal that has been finished, i.e., a "when done" command.

When a task signal 614 is sent to the control module 604, it sends translation signals 606 and rotation signals 608 to move the sealant applicator tool 20 to the desired vector and normal. If the desired vector or normal of the task signal 614 is not reached by means of the translation signals 606 or rotation signals 608, one or more sensor signals 612 proportional to the error in coordinates or angles will be sent to the module 604.

The module 604 then generates appropriate revised translation signals 606 or rotation signals 608 in order to make the correction in vector or normal. The translation signals 606 and rotation signals 608 also include a velocity command that directs the speed of the motors of the gantry device 12 (shown in FIG. 1) in order to control the time at which the desired vector will be reached.

After the desired position is reached, the module 604 sends the operation signal 610 (i.e. the remaining information from the task signal 614) to accomplish the desired work. For example when the sealant applicator tool reaches a desired vector and normal, the module 604 sends to the sealant applicator tool the operation signal 610, comprising for example, an open/close valve signal for dispensing the sealant in order to control precise and accurate dispersement of the sealant. After this operation signal 610 has been sent, module 604 sends the completion signal 618 to the controller 602, which then sends a subsequent task signal 614 to the module 604 and the operation is repeated until all the tasks in the workpiece database 620 have been completed.

In addition, a charge-coupled device (CCD) vision/camera system 19 can be incorporated in the present invention as robotic tool 18 of FIG. 1 or as an add on device. A conventional CCD vision system 19 can be used to scan and map the surface of the workpiece to calculate actual physical geometrical data of the surface scanned. This actual geometrical data is matched and compared with the derived engineering data of the workpiece. Both sets of data are compared and integrated to provide accurate placement and maneuvering of the gantry and its tools, such as the sealant applicator tool, around the workpiece.

In a second preferred embodiment, linear sensors, such as digital strip sensors, are coupled to the translational motors and rotational motors are coupled to rotational sensors. Digital strip sensors are cheaper and less expensive to use than conventional laser measuring means and do not adversely affect the performance of the system. This result can be a significant savings because laser sensors can cost as much as 20 percent of the cost of the system.

This embodiment is achieved by using the digital strips as the sensors to measure the vector of the sealant applicator tool 20 at maximum travel positions of translation modules (not shown, but described in detail in the co-pending patents referenced above) of the gantry 12 and at several commanded intermediate positions. These vectors are compared with the location signals 606 (shown in FIG. 6) sent to reach each of the measured positions, and vector errors are determined for each module. This set of vector errors is programmed into the memory of the controller 602. After this calibration procedure, when the workpiece database 620 requires movement to a set of coordinates, the controller 602 corrects the task signal 614 by the amount of the vector errors. A similar calibration procedure is used to measure normal errors and to eliminate the need for rotational sensors.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An automated sealant applicator system for automatically performing sealant operations on a workpiece, comprising:

a platform;

a numerically controlled gantry slidably coupled to said platform;

said gantry having a robotic arm having an end sealant applicator tool for applying a sealant to said workpiece;

a vertical translation module coupled to said robotic arm and having a vertical movement device for translating said robotic arm along a Z axis;

a plurality of longitudinal translation modules coupled to said robotic arm and said platform and having a longitudinal movement device for translating said longitudinal translation modules along a Y axis;

a transverse translation module coupled to said robotic arm and said vertical translation module and having a transverse movement device for translating said transverse translation module along a X axis;

a charge-coupled device vision/camera system having a positioning and locating system attached to a lower end of said robotic arm to precisely locate and apply said sealant to said workpiece; and a multi-movement control device having preprogrammed instructions stored in programmable memory, wherein said multi-movement control device is electronically coupled to said robotic arm having said end sealant applicator tool for electronically controlling said sealant applicator automatically with said preprogrammed instructions.

2. The invention as set forth in claim 1, wherein said charge-coupled device vision/camera system is a cutter chuck vision system with a positioning and locating system to precisely locate said workpiece and apply sealant to said workpiece.

3. The invention as set forth in claim 1, wherein said multi-movement control device further comprises a coupling for receiving instructions in real-time for electronically controlling said sealant applicator automatically with said real-time instructions.

4. The invention as set forth in claim 1, wherein said multi-movement control device further comprises a path controller for applying controlled amounts of sealant along a preprogrammed path and with desired sealant patterns on said workpiece.

5. The invention as set forth in claim 4, wherein said amounts, path, and patterns of said sealant are derived from predetermined sealant and workpiece engineering data preprogrammed into said multi-movement control device.

6. The invention as set forth in claim 1, further comprising a sealant mixer coupled to said sealant applicator tool for continuously mixing resins to form said sealant.

7. The invention as set forth in claim 6, further comprising a feed pump coupled to said sealant mixer and said multi-movement control device and a feed line coupled between said sealant mixer and said sealant applicator tool, wherein said feed pump and said feed line automatically pump and feed said mixed resins as a sealant to said sealant applicator tool continuously in response to signals from said multi-movement control device.

8. The invention as set forth in claim 1, wherein said sealant applicator tool further comprises an electromechanical plunger device coupled to said multi-movement control device for pneumatically dispensing said sealant automatically in response to signals from said multi-movement control device.

9. The invention as set forth in claim 1, wherein said sealant applicator tool further comprises a sealant head for receiving plural interchangeable sealant tips, wherein each sealant tip creates a desired sealant pattern.

10. An automated sealant applicator system for automatically performing sealant operations on a workpiece, comprising:

at least one support assembly located adjacent a workpiece, said at least one support assembly including at least one engager;

a platform removably attached to an upper end of said at least one support assembly;

a numerically controlled gantry slidably coupled to said platform;

said gantry having a robotic arm having an end sealant applicator tool for applying a sealant to said workpiece;

a vertical translation module coupled to said robotic arm and having a vertical movement device for translating said robotic arm along a Z axis;

a plurality of longitudinal translation modules coupled to said robotic arm and said platform and having a longitudinal movement device for translating said longitudinal translation modules along a Y axis;

a transverse translation module coupled to said robotic arm and said vertical translation module and having a transverse movement device for translating said transverse translation module along a X axis;

said mobile multi-axis numerical controlled robotic arm having said end sealant applicator tool having at least one proximity sensor removably engaged to said at least one engager, wherein said robotic arm is detachably coupled to said at least one support assembly and transportable between at least one support assembly and another support assembly with another workpiece for performing sealant operations on each respective workpiece;

a charge-coupled device vision/camera system having a positioning and locating system attached to a lower end of said robotic arm to precisely locate and apply said sealant to said workpiece; and a multi-movement control device having preprogrammed instructions stored in programmable memory, wherein said multi-movement control device is electronically coupled to said robotic arm having said sealant applicator tool for electronically controlling said sealant applicator automatically with said preprogrammed instructions.

11. The invention as set forth in claim 10, wherein said charge-coupled device vision/camera system is a cutter chuck vision system with a positioning and locating system to precisely locate said workpiece and apply sealant to said workpiece.

12. The system of claim 10, wherein said robotic arm having an end sealant applicator tool further comprises plural movement locating devices and wherein said control device further comprises a controller for storing control signals for each of said respective movement locating device and for said robotic arm having an end sealant applicator tool and for sending said control signals to each of said respective movement locating device and said sealant tool at predetermined intervals.

13. The system of claim 12, wherein said control signals for each of said respective movement locating device further comprises:

a set of cartesian coordinates for each of said respective movement locating devices; and a set of angles for each of said movement locating devices.

14. The system of claim 13, wherein said control signals for said machine tool further comprises:

a set of machine tool operation instructions.

15. The invention as set forth in claim 10, wherein said multi-movement control device further comprises a coupling for receiving instructions in real-time for electronically controlling said sealant applicator automatically with said real-time instructions.

16. The invention as set forth in claim 10, wherein said multi-movement control device further comprises a path controller for applying controlled amounts of sealant along a preprogrammed path and with desired sealant patterns on the workpiece.

17. The invention as set forth in claim 16, wherein said amounts, path, and patterns of said sealant are derived from predetermined sealant and workpiece engineering data preprogrammed into said multi-movement control device.

18. The invention as set forth in claim 10, further comprising a sealant mixer coupled to said sealant applicator tool for continuously mixing resins to form said sealant and a feed device coupled between said sealant mixer and said sealant applicator tool for automatically pumping and feeding said mixed resins as said sealant to said sealant applicator tool continuously in response to signals from said multi-movement control device.

19. The invention as set forth in claim 10, wherein said sealant applicator tool further comprises an electromechanical plunger device coupled to said multi-movement control device for pneumatically dispensing said sealant automatically in response to signals from said multi-movement control device.

20. The invention as set forth in claim 10, wherein said sealant applicator tool further comprises a sealant head for receiving plural interchangeable sealant tips, wherein each sealant tip creates a desired sealant pattern.

21. An automated sealant applicator system for automatically performing sealant operations on a workpiece, comprising:

a support assembly located adjacent said workpiece, said support assembly including a plurality of reference positions;

a platform removably attached to an upper end of said support assembly;

a portable multi-axis, numerically controlled gantry slidably coupled to said platform;

said gantry having a robotic arm having an end sealant applicator tool for applying a sealant to said workpiece;

a vertical translation module coupled to said robotic arm and having a vertical movement device for translating said robotic arm along a Z axis;

a plurality of longitudinal translation modules coupled to said robotic arm and said platform and having a longitudinal movement device for translating said longitudinal translation modules along a Y axis;

a transverse translation module coupled to said robotic arm and said vertical translation module and having a transverse movement device for translating said transverse translation module along a X axis;

said portable multi-axis, numerically controlled gantry having said robotic arm having said end sealant applicator tool with sealant, said gantry being detachably mountable to any one of said reference positions of said support assembly;

a charge-coupled device vision/camera system having a positioning and locating system attached to a lower end of said robotic arm to precisely locate and apply said sealant to said workpiece; and a multi-movement control device coupled to said portable multi-axis gantry for manipulating said gantry and for directing said robotic arm having said sealant applicator tool to apply controlled amounts of sealant to said workpiece.

22. The invention as set forth in claim 21, wherein said charge-coupled device vision/camera system is a cutter chuck vision system with a positioning and locating system to precisely locate said workpiece and apply sealant to said workpiece.

23. The invention as set forth in claim 21, wherein said multi-movement control device further comprises a coupling for receiving instructions in real-time for electronically controlling said sealant applicator automatically with said real-time instructions.

24. The invention as set forth in claim 21, wherein said multi-movement control device further comprises a path controller for applying controlled amounts of sealant along a preprogrammed path and with desired sealant patterns on the workpiece.

25. The invention as set forth in claim 24, wherein said amounts, path, and patterns of said sealant are derived from predetermined sealant and workpiece engineering data preprogrammed into said multi-movement control device.

26. The invention as set forth in clam 21, further comprising a sealant mixer coupled to said sealant applicator tool for continuously mixing resins to form said sealant.

27. The invention as set forth in claim 26, further comprising a feed pump coupled to said sealant mixer and said multi-movement control device and a feed line coupled between said sealant mixer and said sealant applicator tool, wherein said feed pump and said feed line automatically pump and feed said mixed resins as a sealant to said sealant applicator tool continuously in response to signals from said multi-movement control device.

28. The invention as set forth in claim 21, wherein said sealant applicator tool further comprises an electromechanical plunger device coupled to said multi-movement control device for pneumatically dispensing the sealant automatically in response to signals from said multi-movement control device.

29. The invention as set forth in claim 21, wherein said sealant applicator tool further comprises a sealant head for receiving plural interchangeable sealant tips, wherein each sealant tip creates a desired sealant pattern.

30. An automated sealant applicator system for automatically performing sealant operations on a workpiece, comprising:

a reconfigurable gantry tool, comprising a platform, a sine plate rotatably and slidably coupled to said platform, and a numerically controlled gantry slidably and rotatably coupled to said platform to allow multi-axis movement of said gantry;

wherein said gantry includes a sealant applicator tool with sealant; and a multi-movement control device coupled to said platform, sine plate, and gantry for controlling movement of said coupled devices and for directing said robotic arm having said sealant applicator tool to apply controlled amounts of sealant to said workpiece.

31. The system of claim 30, wherein said reconfigurable gantry tool is a first reconfigurable gantry tool, wherein said system further comprises a second reconfigurable gantry tool with a second tool coupled to said first reconfigurable gantry tool for receiving said workpiece from said sine plate and for performing secondary tooling operations on said workpiece.

32. The system of claim 30, wherein said control device comprises:

a controller for storing control signals of movement devices attached to said gantry and said sealant applicator tool, and for sending said control signals to each of said respective movement devices and said sealant applicator tool at predetermined intervals.

33. The system of claim 32, wherein said control signals for each of said respective movement devices further comprises:

a set of cartesian coordinates for each of said respective movement devices; and a set of angles for each of said respective movement device.

34. The system of claim 33, wherein said control signals for said sealant applicator tool further comprises:

a set of machine tool operation instructions.

35. The invention as set forth in claim 30, wherein said multi-movement control device further comprises a coupling for receiving instructions in real-time for electronically controlling said sealant applicator automatically with said real-time instructions.

36. The invention as set forth in claim 30, wherein said multi-movement control device further comprises a path controller for applying controlled amounts of sealant along a preprogrammed path and with desired sealant patterns on the workpiece.

37. The invention as set forth in claim 36, wherein said amounts, path, and patterns of said sealant are derived from predetermined sealant and workpiece engineering data preprogrammed into said multi-movement control device.

38. The invention as set forth in claim 30, further comprising a sealant mixer coupled to said sealant applicator tool for continuously mixing resins to form said sealant and a feed device coupled between said sealant mixer and said sealant applicator tool for automatically pumping and feeding said mixed resins as a sealant to said sealant applicator tool continuously in response to signals from said multi-movement control device.

39. The invention as set forth in claim 30, wherein said sealant applicator tool further comprises an electromechanical plunger device coupled to said multi-movement control device for pneumatically dispensing the sealant automatically in response to signals from said multi-movement control device.

40. The invention as set forth in claim 30, wherein said sealant applicator tool further comprises a sealant head for receiving plural interchangeable sealant tips, wherein each sealant tip creates a desired sealant pattern.

* * * * *